United States Patent [19]

Taniguchi

[11] Patent Number: 4,467,732

[45] Date of Patent: Aug. 28, 1984

[54] MELTING APPARATUS

[75] Inventor: Kotaro Taniguchi, Sakai, Japan

[73] Assignee: Kubota, Ltd., Osaka, Japan

[21] Appl. No.: 533,506

[22] Filed: Sep. 19, 1983

[30] Foreign Application Priority Data

Sep. 27, 1982 [JP] Japan ..... 57-146455

[51] Int. Cl.[3] ..... F23G 3/00; F23G 7/00

[52] U.S. Cl. ..... 110/259; 110/165 R; 110/171; 110/216

[58] Field of Search ..... 110/235, 238, 259, 165 R, 110/171, 347, 346, 203, 216

[56] References Cited

U.S. PATENT DOCUMENTS

| | | | |
|---|---|---|---|
| 2,983,234 | 5/1961 | Reilly | 110/259 X |
| 3,537,410 | 11/1970 | Zanft | 110/259 X |
| 3,842,762 | 10/1974 | Sargent | 110/259 X |
| 3,958,518 | 5/1976 | Yoshida | 110/165 R X |
| 4,285,282 | 8/1981 | Good | 110/259 |

FOREIGN PATENT DOCUMENTS

| | | | |
|---|---|---|---|
| 2539105 | 9/1975 | Fed. Rep. of Germany | 110/259 |
| 150722 | 9/1982 | Japan | 110/259 |

*Primary Examiner*—Edward G. Favors

*Attorney, Agent, or Firm*—W. G. Fasse; D. H. Kane, Jr.

[57] ABSTRACT

A melting apparatus has a low temperature melting portion (29), an exhaust gas cooling portion (26), and a dust collecting portion (B27) which are arranged, in succession, in an exhaust gas duct (54) of a melting furnace (B22). A low boiling point dust collected in the dust collecting portion (B27) is returned to the low temperature melting portion (29) for melting by retention heat of an exhaust gas flowing into the exhaust gas duct (54).

7 Claims, 4 Drawing Figures

MELTING APPARATUS

BACKGROUND OF THE INVENTION

1. Field of the Invention

The present invention relates to a melting apparatus for melting and slagging a waste water treatment sludge, an ash or dust discharged from an incinerating apparatus, or the like and, more particularly, relates to a melting apparatus comprising a structure for effectively collecting low boiling point dust apt to circulate in the dust collecting path.

2. Description of the Prior Art

In arrangements for incinerating and treating a waste to be treated, it is widely used, for the purpose of solidifying an incinerated residue and collected dust, that a melting furnace is provided in the post process of an incinerating furnace, wherein the incinerated residue and the collected dust are melted and slagged, and then the melted slag is cooled and solidified to be discharged. A waste water treatment sludge is directly melted in a melting furnace to produce a melted slag which then is cooled and solidified to be discharged.

FIG. 1 shows a flow diagram of a conventional melting apparatus for performing the above described melting and treatment. After collected waste 1 temporarily is stored in a reservoir pit, the waste 1 is incinerated in an incinerating furace. An incinerated residue 2 such as ash or non-combustible material, and exhaust gas 3 are discharged from the incinerating furnace. Of these, the incinerating residue 2 is introduced into a melting furnace, the temperature of which is raised to a predetermined temperature, and is melted and slagged, and then the melted slag is cooled and solidified to be discharged as a solid slag 7 out of of the system. On the other hand, the exhaust gas 3 is passed to an exhaust gas cooling portion A (for example, a water sprinkling cooler apparatus) so that the gas 3 is cooled, and then, after the dust included in the exhaust gas is removed in a dust collecting portion A, the gas is discharged to the exterior. The dust 4 collected in the dust collecting portion A is introduced into the melting furnace wherein the dust 4 is melted and slagged together with the incinerated residue 2. In addition, an exhaust gas 5 generated when the incinerated residue 2 and the collected dust 4 are melted in the melting furnace, is introduced into a heat exchanger and cooled therein, and then, is through a line 6 to be joined with the exhaust gas 3 from said incinerating furnace through a line 6 to be supplied to the dust collecting portion A in which the dust is again collected.

However, the chloride or dust generated or collected in the above described melting furnace contains components such as $ZnCl_2$, $PbCl_2$, $CdCl_2$, KCl, NaCl and $FeCl_2$, having a lower boiling point than the temperature within the melting furnace. These low boiling point dusts are gasified in the melting furnace and thus discharged with the exhaust gas and the like. Therefore, such dust can not be solidified. If such gasified component having a low boiling point is cooled in a heat exchanger, the component is again solidified to become dust and is collected in the dust collecting point A. Thus, the collected dust is again introduced into the melting furnace. However, since the internal temperature in the melting furnace is higher than the boiling point of the low boiling point component, the low boiling point components are again gasified to circulate in the system. Thus, such low boiling point components always continue to circulate in the collecting system and hence are not discharged to the exterior of the system. Therefore, while such kind of melting apparatus continues to be driven for a longer time period, such low boiling point dust is stored in the collecting system and a considerable amount thereof is deposited on an inner surface of each tube of a heat exchanger through which the exhaust gas 5 from the melting furnace flows. Such deposits block the heat exchanger tubes or cause a failure of the tube and heat exchanger.

Then, the present inventor has proposed a structure for overcoming such a problem in his prior filed Japanese patent application No. 100119/1982 which has not been laid open for public inspection. In that application, a structure is disclosed wherein a separate dust collecting portion is provided in an exhaust gas line 6 of the melting furnace, in which dust collecting portion the low boiling point dust is collected and is introduced into a separately designed melting furnace having a lower furnace temperature in which the low boiling point dust is melted and slagged and is discharged to the exterior of the system.

However, even in such an improved melting apparatus, there are some problems because the structure is relatively complicated and the operation of the re-melting furnace is expensive.

SUMMARY OF THE INVENTION

Accordingly, a principal object of the present invention is to provide a melting apparatus capable of effectively discharging a low boiling point dust to an exterior of the system, the structure thereof being relatively simple and its operation expense being small.

Briefly stated, the present invention is directed to a melting apparatus comprising a melting furnace for melting a waste for discharging the same from the slag discharging port, an exhaust gas duct diverged from the slag discharging port of the melting furnace for discharging an exhaust gas generated in the melting furnace, a low temperature melting portion provided in the exhaust gas duct for melting dust contained in the exhaust gas, an exhaust gas cooling portion provided on a farther downstream side than the lower temperature melting portion in the exhaust gas duct for cooling the exhaust gas, a dust collecting portion provided on a farther downstream side than the exhaust gas cooling portion, a first dust supplying line for introducing the low boiling point dust collected in the dust collecting portion to the low temperature melting portion, and cooling means for cooling the melted substance discharged from the low temperature melting portion.

The above described structure of the present invention makes it possible to economically slag relatively low boiling point dust and also to surely prevent an accident such as blocking a duct or a dust collector, since no dust is stored in a system.

These objects and other objects, features, aspects and advantages of the present invention will become more apparent from the following detailed decription of the present invention when taken in conjunction with the accompanying drawings.

DESCRIPTION OF THE PREFERRED EMBODIMENTS

Figure 1:
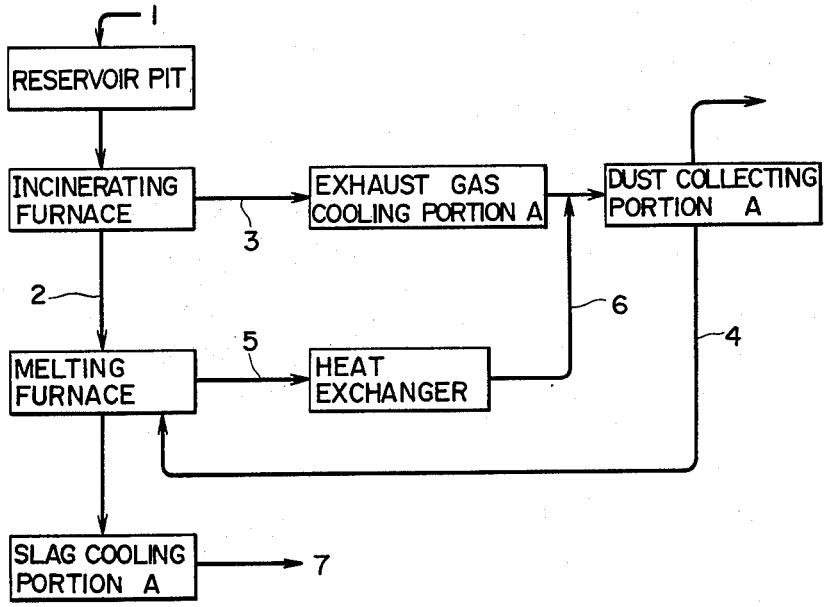
FIG. 1 PRIOR ART
FIG. 1 is a flow diagram of a conventional waste melting system.
Figure 2:
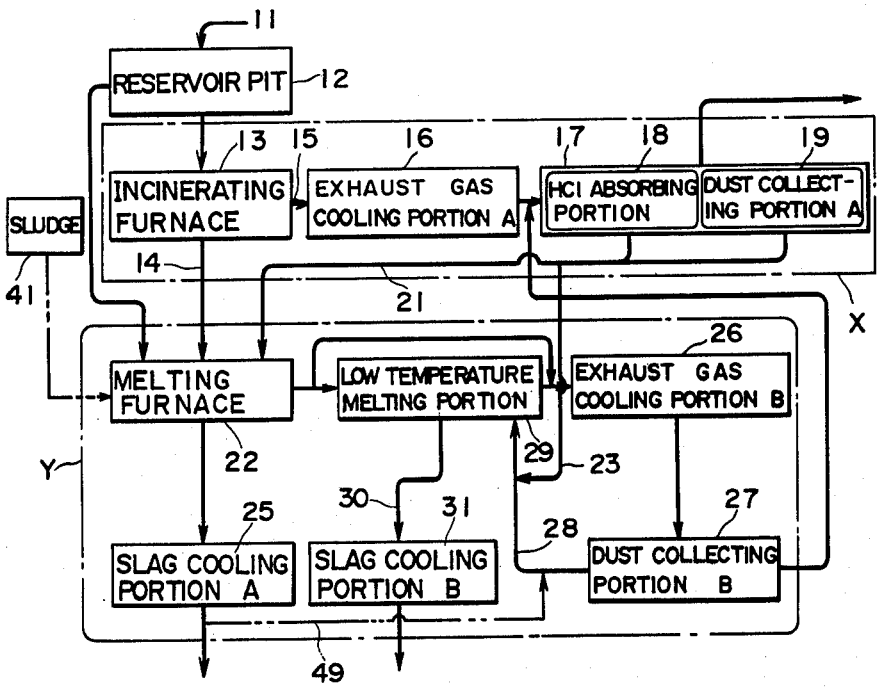
FIG. 2 is a flow diagram of a system in which a melting apparatus of one embodiment of the present invention is incorporated.

FIG. 2 is a flow diagram for explaining the operation of a melting apparatus of one embodiment of the present invention. As seen from FIG. 2, the present melting apparatus comprises an incinerating and treating portion encircled by a chain line X and a melting and treating portion encircled in a chain line Y. A reference character A in the following description indicates a structure included in a conventional apparatus shown in FIG. 1 and a reference character B indicates apparatuses provided for the first time in this embodiment.

A waste 11 to be incinerated and treated is stored in a reservoir pit 12, and then is introduced into an incinerating furnace 13 wherein the waste 11 is incinerated and treated, so that an incinerated residue 14 and an exhaust gas 15 are generated. The incinerated residue 14 is supplied to a melting and treating portion Y described below. On the other hand, the exhaust gas 15 generated in the incinerating furnace 13 is cooled in an exhaust gas cooling portion A16, and then is introduced into an exhaust gas treating portion 17. The exhaust gas treating portion 17 comprises an HCl absorbing portion 18 and a dust collecting portion A19. HCl generated in the incinerating furnace, for example, by combustion of PVC products and the like, is removed by absorption or adsorption thereof in the HCl absorbing portion 18. When HCl is absorbed, $CaCO_3$, $Ca(OH)_2$, CaO, NaOH or the like is used in a dry method or a wet method. As a result of the absorbing action, $CaCl_2$, NaCl or the like (referred to as "chloride" hereinafter) is formed. On the other hand, the dust in the exhaust gas is collected in the dust collecting portion A19.

The chloride formed in the HCl absorbing portion 18 and the dust collected in the dust collecting portion A19 are gathered together to be supplied to a melting furnace 22 through a second dust supplying line 21. A separate dust supplying line 23 is diverged from the dust supplying line 21. The dust supplying line 23 is introduced into a low temperature melting furnace 29 of the melting and treating portion Y described below.

The incinerated residue 14 and the chloride, dust and the like in the exhaust gas are applied to the melting furnace 22 and are melted and slagged therein, and, thereafter, the melted slag is cooled and solidified in a slag cooling portion A25 to be discharged as a solid slag to an exterior of the system.

The melting furnace 22 is usually maintained at a relatively high temperature such as 1300° C.–1500° C. Thus, the exhaust gas generated in the melting furnace 22 contains a large amount of gasification substances of the above described low boiling point dust component. The gasification substance is cooled and solidified in an exhaust gas cooling portion B26 provided in the exhaust gas duct, and thereafter, is collected in a dust collecting portion B27. The low boiling point dust collected in the dust collecting portion B27 is applied to the low temperature melting portion 29 through a first dust supplying line 28. As apparent from FIG. 2, the low temperature melting portion 29 is disposed on the upstream side as compared with the exhaust gas cooling portion B26. Accordingly, an exhaust gas including a heat quantity discharged from the melting furnace 22 is supplied to the low temperature melting portion 29 and thus the low boiling point dust is melted and treated by the heat quantity of the exhaust gas. As a result, the low boiling point component becomes a melted slag 30 so that it is discharged as a solid slag to an exterior of the system from the slag cooling portion B31.

In the above described apparatus shown in FIG. 2, the incinerating furnace 13 is disposed in the front stage of the melting furnace 22. However, in case where a waste to be treated is a waste water treatment sludge, as shown in a phantom line in FIG. 2, it is possible to treat the waste water treatment sludge 41 by directly supplying the sludge 41 to the melting furnace 22, without using an incinerating furnace 13 or the like. In such a case, the dust supplied to the low temperature melting portion 29 is only a dust collected in the dust collecting portion B27.

However, as an alternative means, a portion of solid slag discharged from the slag cooling portion A25 may be supplied to the low temperature melting portion 29 through a slag supplying line 49 (shown as a phantom line in FIG. 2), together with the dust from the dust collecting portions B27.

Now, a specific structure of the present melting apparatus will be described with reference to FIG. 3. The most significant feature of the apparatus resides in a low temperature melting portion in which sensible heat of an exhaust gas generated in the melting furnace is directly utilized, without comprising a low temperature melting portion requiring a separate heat source such as the above described invention in the prior filed application.

Figure 3:
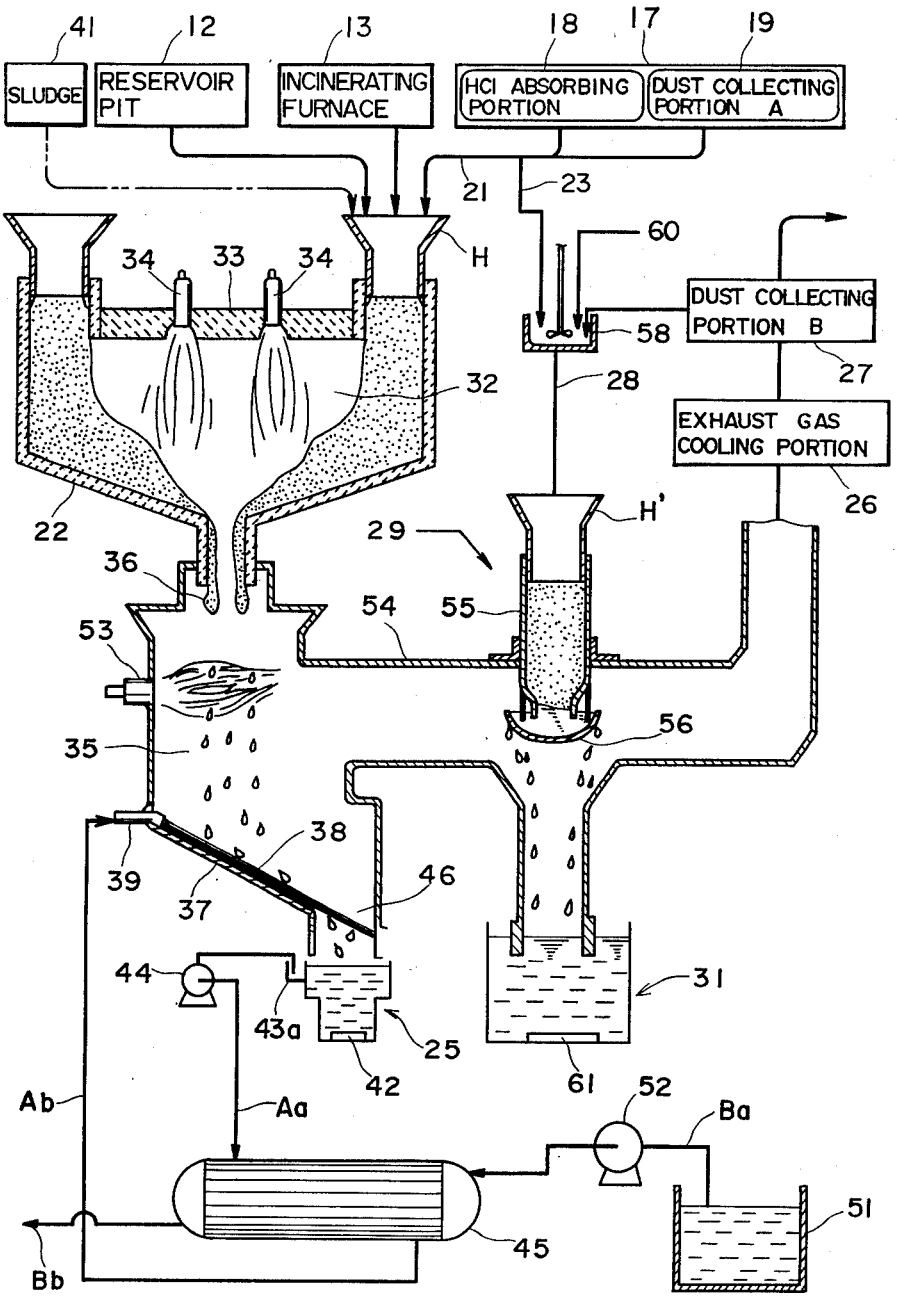
FIG. 3 is a schematic cross-sectional view showing a structure of a melting apparatus of the present invention shown in FIG. 2.

Referring to FIG. 3, the present melting apparatus comprises a melting furnace 22, a low temperature melting portion 29, a cooling water reservoir 25 for slag from the melting furnace, a cooling water reservoir 31 for slag from the low temperature melting portion (corresponding to the slag cooling portion B31 in FIG. 2), an exhaust gas cooling portion B26, a dust collecting portion B27 and the like. A hopper H is provided in an upper portion of the melting furnace 22. The wastes, such as shredded waste from the reservoir pit 12, the incinerated ash from the incinerating furnace 13, the chloride collected in the HCl absorbing portion 18, the collected dust from the dust collecting portion A19 and the like are collectively supplied to the hopper H. As described in the foregoing, in the treatment of a waste such as a waste water treatment sludge, such waste water treatment sludge is directly supplied to the hopper H and is melted and treated as described subsequently.

The waste to be treated and supplied through the hopper H is melted by flame heat from burners 34, 34 located approximately in a mid portion of an upper refractory wall 33 in a flame chamber 32 in the melting furnace 22. An afterburning chamber 35 is formed in the bottom of the melting furnace 22. The afterburning chamber 35 serves as a dropping path and for afterburning of exhaust gas (incomplete combustion exhaust gas containing $H_2$, CO and the like) generated in the melting furnace. The melted slag 36 drops onto an inclined bottom portion 37 of the afterburning chamber 35.

In the present embodiment, an inclined slag chute 38 is provided in such a manner that the surface of the inclined bottom portion 37 is covered with the chute 38. The inclined slag chute 38 is made of, for example, a stainless steel plate having a good corrosion-resistance and a good heat-resistance. A cooling water supplying port 39 is provided in a side wall of the afterburning chamber 35 in the upper portion of the inclined slag chute 38 and cooling water is supplied to the inclined slag chute 38 from the cooling water supplying port 39. Thus, the melted slag 36 dropping to the afterburning chamber 35 does not contact directly the inclined bottom portion 37, but drops onto the inclined slag chute 38. Therefore, the damage of the inclined bottom portion 37 caused by the heat of the melted slag 36 can be effectively prevented. In addition, the damage of the inclined bottom portion 37 caused by dropping of the melted slag 36 can be also avoided, since the shock at the time of dropping of the melted slag 36 is softened by the inclined slag chute 38. The melted slag, dropping together with the cooling water from the inclined slag chute 38, is solidified in the cooling water reservoir 25 and discharged to the exterior of the system by a conveyor 42.

Surplus cooling water circulating paths Aa, Ab are provided between the cooling water supplying port 39 and a cooling water collecting path 43*a*. Paths Aa, Ab serve as a circulating path for cooling water supplied onto the inclined slag chute 38 from the cooling water supplying port 39. In this case, a portion of the cooling water in the cooling water reservoir 25 is utilized as cooling water. More particularly, the water circulated as cooling water is the water flowing into the surplus cooling water collecting path 43*a* provided in the upper portion of the cooling water reservoir 25 whereby the surplus cooling water is pumped by a pump 44 and is fed to a heat exchanger 45 from the cooling water circulating path Aa. After the water is cooled in the heat exchanger 45, the water is introduced into the cooling water supplying port 39 through the cooling water circulating path Ab. Then, the cooling water discharged from the cooling water supplying port 39 flows into the cooling water reservoir 25 through the inclined slag chute 38 and again overflows to the surplus cooling water collecting path 43*a*. Thus, the cooling water is circulated and is always supplied onto the inclined slag chute 38, so that the dropping melted slag 36 is smoothly carried down the cooling water reservoir 25 and is cooled therein. Accordingly, the above described problem that the inclined bottom portion 37 is heated, has been effectively overcome.

The melted slag 36 is cooled on the inclined slag chute 38 by the cooling water, and hence water vapor is generated. However, it can be understood that the place where the water vapor is actually generated is a lower portion of a communicating path 46, since the cooling water always flows over the inclined slag chute 38. The cooling water flowing down through the inclined slag chute 38 forms an inclined water film, that is a water curtain in the portion of the communicating path 46. Accordingly, the water vapor generated in the cooling water reservoir 25 is prevented from rising by the water curtain. Therefore, water vapor cannot flow into the interior of the afterburning chamber 35 and hence the temperature in the afterburning chamber 35 can be maintained constant.

On the other hand, a cooling medium, such as water, continues to be supplied from the tubes Ba, Bb to the heat exchanger 45, for the purpose of cooling the cooling water fed by the pump 44. More particularly, the cooling medium is supplied to the heat exchanger 45 from the reservoir tank 51 by a pump 52 and is heat exchanged in the heat exchanger 45, and then, is discharged from the tube Bb. The cooling medium fed out from the tube Bb, that is, the heated cooling medium is appropriately supplied to a terminal apparatus for utilizing remaining heat, so that the exhaust heat can be effectively utilized.

Now, the treatment of the dust in the exhaust gas, which is a characterized structure of the present invention, will be described. An incomplete combustion exhaust gas generated in the melting furnace 22 is completely burnt up by an afterburning burner 53 provided in the afterburning chamber 35. The exhaust gas completely burnt up is introduced into the exhaust gas cooling portion B26 through an exhaust gas duct 54 diverged from the afterburning chamber 35. In the exhaust gas cooling portion B26, the gasification substance of the low boiling point dust in the exhaust gas is cooled and solidified. The solidified dusts are collected in the dust collecting portion B27 and purified exhaust gas is discharged to the exterior of the system.

On the other hand, a low temperature melting portion 29 is interposed on the upstream side of the exhaust gas cooling portion B26 of the exhaust gas duct 54. The low temperature melting portion 29 has a silo-like charging tube 55 the outer surface of which is covered with refractory material, and a pan 56 depending from a lower portion of the silo-like charging tube 55. A water seal type of cooling water reservoir 31 for slag from the low temperature melting portion is disposed in a lower portion of the low temperature melting portion 29. The dust collected in the dust collecting portion B27 as described in the foregoing is applied to the low temperature melting portion 29 through the first dust supplying line 28. A mixer 58 is provided midway in the dust supplying line 28. To the mixer 58 is connected a third dust supplying line 23 diverged from the second dust supplying line 21 which is directed to the melting furnace 22 from the HC1 absorbing portion 18 and the dust collecting portion A19 of the incinerating and treating portion 17. In addition, an introduction line 60 for adding $FeSO_4$ is connected to the mixer 58. Accordingly, the dust and $FeSO_4$ are applied together to the low temperature melting portion 29. The mixer 58 includes a structure adapted such that the compounding ratio of the dusts supplied from the dust supplying lines 28 and 23 can be selected to have a preferred predetermined value as described. In addition, it is desirable to uniformly mix each of the dusts for the mixer 58, in supplying the dust to the low temperature melting portion 29. For this reason, warm water supplied from the tube path Bb utilizing the above described remaining heat is introduced into the mixer 58 in which each dust and $FeSO_4$ may be mixed by any agitating means. Water may be mixed instead of warm water. As the agitating means, a well-known mechanical agitator, an air bubbling or the like can be employed. In addition, if the gas discharged from the dust collecting portion B27 is used for the air bubbling, the apparatus can be simplified. The reason why the mixer 58 is provided in which the dust supplied from the dust supplying line 23 from an incinerating and treating portion is mixed will be described in detail below.

The dust applied to the low temperature melting portion 29 becomes pasty, and thus flows down to the silo-like charging tube 55. Since the tip of the silo-like charging tube 55 is inserted into the exhaust gas duct 54, the paste-like dust is heated by the high temperature exhaust gas flowing into the exhaust gas duct 54 and hence the temperature thereof is gradually raised. Since the temperature of the exhaust gas flowing into the exhaust gas duct is lower than the temperature in the melting furnace 22 and the afterburning chamber 35, the low boiling point dust is not gasified. Accordingly, the low boiling point dust is surely melted in the low temperature melting portion 29 and stored in the pan 56. The melted dust overflows over the edge of the pan 56 and drops into the cooling water reservoir 31. The melted slag is cooled and solidified in the cooling water reservoir 31, and then, discharged to the exterior by a conveyor 61. In the above described melting apparatus, the temperature in the melting furnace 22 is raised to about 1350° C. for the purpose of melting and slagging high boiling point dust such as incinerated ash. However, the temperature of the exhaust gas arriving at the low temperature melting portion 29 from the melting furnace 22 through the afterburning chamber 35 and the exhaust gas duct 54 ranges from 1000° C. to 1200° C. Thus, the temperature of the dust in the charging tube 55, which is heated by the exhaust gas, is raised to at most 900° C. to 950° C. and hence, the low boiling point dust in the charging tube 55 is merely melted and is not gasified. Hence, the low boiling point dust becomes a melted slag and drops into the cooling water reservoir 31.

The feature of the melting apparatus of the present embodiment resides in the point that a low boiling point dust is selectively extracted and is melted and slagged in the range of temperature higher than the melting point and lower than the boiling point by utilizing, as heat source, the retention heat of the exhaust gas. Therefore, it can be understood that the low boiling point dust can be economically slagged.

Now, the mixture in the above described agitator 58, of the dust supplied from the dust supplying line 28 with the dust supplied from the dust supplying line 23 will be described. It is first pointed out that the mixer 58 is not an indispensable constituent element of the present invention. More particularly, without the mixer 58 and the dust supplying line 23, only the dust generated in the dust collecting portion B27 may be supplied to the low temperature melting portion 29 through the dust supplying line 28. Even in such a case, it can be understood that the low boiling point dust is melted and slagged by the retention heat of the exhaust gas flowing into the exhaust gas duct 54 and hence can be surely discharged to the exterior of the system. However, preferably, as described in the foregoing, there is provided the mixer 58 to which the dust supplying line 23 from the incinerating and treating portion and the $FeSO_2$ introduction line 60 are connected, and as a result, a mixed dust is supplied to the low temperature melting portion 29. The reason will be described based on the following experimental examples.

Figure 4:
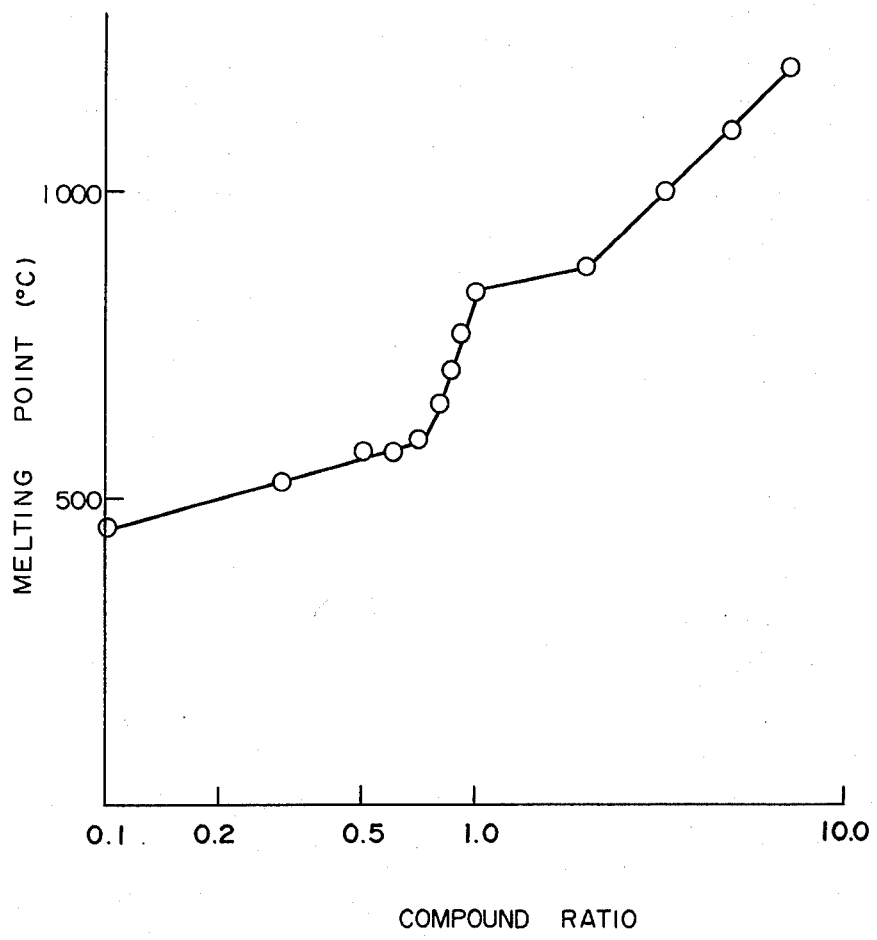
FIG. 4 is a graph showing a relation between a compounding ratio of dust supplied to a low temperature melting portion from a first dust supplying line to dust supplied to the low temperature melting portion from a third dust supplying line and a melting point of the dust supplied to the low temperature melting portion.

FIG. 4 is a graph showing a variation of melting point of the mixed dust in case where a mixing ratio of the dust supplied from the dust supplying line 28 to the dust supplied from the dust supplying line 23 is changed. As seen from FIG. 4, it will be understood that the melting point of the mixed dust exceeds 900° C. if and when the compounding ratio of the dust supplied from the dust supplying line 28 to the dust supplied from the dust supplying line 58 exceeds 1:2. Accordingly, if and when the compounding ratio exceeds 1:2, the low boiling point dust such as a chloride is gasified and hence can not be melted and slagged. Therefore, it is required that the compounding ratio of the dust supplied from the dust supplying line 28 to the dust supplied from the dust supplying line 50 is less than 1:2. Preferably, it is desirable that the ratio is less than 1:0.9. As a result, the melting point of the mixed dust can be made to be less than 800° C. and gasification of the low boiling point dust can be surely prevented.

The essential reason for treating a mixed dust is that elution of heavy metals such as Cd, Pb or the like from the slag cooled and solidified in the low temperature melting portion 29 and the slag cooling water reservoir 31, is prevented. More particularly, the elution of heavy metals such as Cd, Pb and the like from the slag which is obtained by applying only the low boiling point dust collected in the dust collecting portion 27 to the low temperature melting portion 29 through the dust supplying line 28, has been confirmed by experiment. In order to prevent such elution, the dust from the dust supplying line 23 is mixed in the mixer 58, as described in the foregoing. As a result of repetition of the experiment with various kinds of conditions in the melting apparatus of the present embodiment, the following results were obtained. Table 1 indicates the result of elution of heavy metals from the obtained slag.

TABLE 1

| No. | COMPOUND RATIO | MELTING TEMPERATURE | AMOUNT OF ELUTION OF HEAVY METALS mg/l Cd | Pb |
|---|---|---|---|---|
| 1 | 1:0 | 900° C. | 59 | 18 |
| 2 | 1:0.6 | 900° C. | 0.33 | 0.5 |
| 3 | 1:0.7 | 900° C. | 0.02 | 0.5 |
| 4 | 1:0.8 | 900° C. | 0.3 | 0.4 |
| 5 | 1:0.85 | 900° C. | 0.29 | 0.4 |
| 6 | 1:0.9 | 900° C. | 0.12 | 0.4 |
| 7 | 1:1 | 900° C. | <0.01 | 9.6 |
| 8 | 0.5:1 | 900° C. | <0.01 | 24 |

As seen from Table 1, it will be understood that the elution amount of Pb and Cd can be controlled to be as small as shown above provided that the compounding ratio of the melted dust supplied from the dust supplying line 28 to the incinerated dust supplied from the dust supplying line 23 is 1:0.7–1:0.9. However, it will be also understood that the compounding ratio may range from 1:05 to 1:09 if the elution of Cd is neglected and the elution amount of Pb is controlled to be less than 3.0 PPM.

Conversely, in case where it is possible to neglect the elution of Pb and it is required that the elution amount of Cd is controlled to be less than 0.3 PPM, the compounding ratio may be over 1:0.6. As apparently seen from the above described result of Table 1, elution of heavy metals from the slag formed in the low temperature melting portion 29 and the slag cooling water reservoir 31 can be effectively prevented by mixing the dust of the incinerating and treating portion from the dust supplying line 23 in the mixer 58.

Now, the advantage of connecting the $FeSO_4$ introduction line 60 to the mixer 58 will be described. Table 2 indicates the result of experiment in case where $FeSO_4$ is mixed.

TABLE 2

| No. | COMPOUND RATIO | AMOUNT OF $FeSO_4$ | AMOUNT OF ELUTION OF HEAVY METALS* Cd | Pb |
|---|---|---|---|---|
| 1 | 1:0.85 | 1% | 0.30 | 0.2 |
| 2 | 1:0.90 | 1% | 0.10 | 0.2 |
| 3 | 1:1.0 | 1% | 0.01 | 0.2 |
| 4 | 1:0.85 | 0 | 0.80 | 0.5 |
| 5 | 1:0.90 | 0 | 0.13 | 0.3 |
| 6 | 1:1.0 | 0 | 0.01 | 0.3 |

*: mg/l

As seen from Table 2, it will be understood that the elution amount of Cd and Pb can be effectively reduced if 1% of $FeSO_4$ is added as compared with the case where such is not added. In addition, it was confirmed that if $FeSO_4$ is added, the mixed dust agitated in the agitator 58 is made more uniform and hence a mixed dust of stabilized composition can be obtained and thus the elution amount of heavy metals from the slag can be surely reduced to less than a predetermined value.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A melting apparatus comprising:

a melting furnace (22) for melting a waste and discharging a slag from a discharging port thereof, an exhaust gas duct (54) diverged from the slag discharging port of said melting furnace for discharging an exhaust gas generated in said melting furnace, a low temperature melting portion (29) provided in said exhaust gas duct (54) for melting low boiling point dust contained in the exhaust gas, an exhaust gas cooling portion (26) provided on a farther downstream side of said exhaust gas duct (54) than said low temperature melting portion (29) for cooling the exhaust gas, a dust collecting portion (27) provided on a farther downstream side of said exhaust gas duct (54) than said exhaust gas cooling portion (26) for collecting dust contained in the exhaust gas, a first dust supplying line (28) for introducing the low boiling point dust collected in said dust collecting portion into said low temperature melting portion (29), and cooling means (31) for cooling melted material discharged from said low temperature melting portion (29).

2. The melting apparatus in accordance with claim 1, further comprising, an incinerating furnace (13) disposed in a front stage of said melting furnace, said incinerating furnace (13) being provided with an exhaust gas cooling portion (16) for cooling an exhaust gas generated in incinerating, and a dust collecting portion (17) for the incinerating furnace for collecting dust from said exhaust gas, a second dust supplying line (21) for supplying to said melting furnace the dust collected in said dust collecting portion for said incinerating furnace, and a third dust supplying line (23) diverged from said second dust supplying line (21) and connected to said first dust supplying line (28).

3. The melting apparatus in accordance with claim 2, wherein said dust supplying lines (23, 28) are connected to each other such that the dust supplied to said low temperature melting portion (29) through said third dust supplying line (23) is at most 0.9 times of the dust supplied through said first dust supplying line (28).

4. The melting apparatus in accordance with claim 3, wherein the ratio of the dust supplied to said low temperature melting portion (29) through said first dust supplying line (28) to the dust supplied to said low temperature melting portion (29) through said third dust supplying line (23) ranges from 1:0.85 to 1:0.90.

5. The melting apparatus in accordance with claim 2, which further comprises an agitating and mixing apparatus (58) located in a portion where the first dust supplying line (28) and said third dust supplying line (23) are connected, and an $Fe_2SO_4$ introduction line (60) connected to said agitating and mixing apparatus, other than said first and third dust supplying lines (23, 28).

6. The melting apparatus in accordance with claim 1, wherein said cooling means comprises a cooling water reservoir (31) for cooling melted material of the low boiling point dust.

7. The melting apparatus in accordance with claim 1, which further comprises a solid slag discharging conveyor (42) disposed in a lower portion of a melted slag dropping port of said melting furnace, an inclined slag chute (38) provided in said melted slag dropping port, a cooling water supplying port (39) provided on an upper portion of said inclined slag chute (38) for flowing a cooling water to an inclined surface of the slag chute, a cooling water collecting path (**43*a*) provided in said solid slag discharging conveyor (42) in a low in the lower portion of said inclined slag chute, wherein said cooling water supplying port (39) and said cooling water collecting path (43*a*) are connected by tube paths (Aa, Ab) so that a circulating water path is formed, and a heat exchanger (45**) for cooling circulating water disposed in the circulating water path.

* * * * *